US009820521B2

(12) United States Patent
Kim

(10) Patent No.: US 9,820,521 B2
(45) Date of Patent: Nov. 21, 2017

(54) BRACING STRUT FOR PREVENTING PANTS FROM SLIPPING DOWN

(71) Applicant: Dae Woon Kim, Seoul (KR)

(72) Inventor: Dae Woon Kim, Seoul (KR)

( * ) Notice: Subject to any disclaimer, the term of this patent is extended or adjusted under 35 U.S.C. 154(b) by 73 days.

(21) Appl. No.: 14/772,132

(22) PCT Filed: Jan. 13, 2014

(86) PCT No.: PCT/KR2014/000369
§ 371 (c)(1),
(2) Date: Sep. 2, 2015

(87) PCT Pub. No.: WO2014/148733
PCT Pub. Date: Sep. 25, 2014

(65) Prior Publication Data

US 2016/0015105 A1 Jan. 21, 2016

(30) Foreign Application Priority Data

Mar. 19, 2013 (KR) ..... 10-2013-0029140

(51) Int. Cl.
*A41F 5/00* (2006.01)
*A41F 9/00* (2006.01)

(52) U.S. Cl.
CPC . *A41F 5/00* (2013.01); *A41F 9/00* (2013.01)

(58) Field of Classification Search
CPC ..... A41F 5/00; A41F 9/00
See application file for complete search history.

(56) References Cited

U.S. PATENT DOCUMENTS 350,846 A * 10/1886 Sanders ..... A41F 5/00 217/94
809,074 A * 1/1906 Niles ..... A41F 11/16 2/308
1,206,070 A * 11/1916 Wohlgemuth ..... A41F 11/16 2/308

(Continued)

FOREIGN PATENT DOCUMENTS

KR 20120037342 A 4/2012

OTHER PUBLICATIONS

International Search Report; dated Oct. 1, 2015;—English Translation.

*Primary Examiner* — Khaled Annis
(74) *Attorney, Agent, or Firm* — Bennett Mullinax, LLC

(57) ABSTRACT

The present invention relates to a bracing strut for preventing pants from slipping down. The bracing strut according, to the present invention comprises: holders (4) on the left and right of the front side of a waist band (B) of a pair of pants (P); and sockets (5) formed on a buckle (5*a*) on the left and right of the front side of a hip belt (G) to be worn on a body, wherein the pants (P) are supported by the hip belt due to the bracing strut in such a manner that, after the hip belt (G) is fastened on the body and then the pants are worn, both ends of the bracing strut (S) are supported between the holders (4) provided in the waist band (B) of the pants (P) and the sockets (5) provided in the hip belt (G). According to the present invention, no pressure is applied to the abdomen because a waist belt is not fastened to wear a pair of pants, contrary to a conventional manner, and shoulder straps, are not slipped down because suspenders are not used. Thus, everybody can wear a pair of formal pants in a comfortable and unrestricted way.

7 Claims, 3 Drawing Sheets

(56) References Cited

U.S. PATENT DOCUMENTS

| | | | | | |
|---|---|---|---|---|---|
| 1,488,750 | A * | 4/1924 | Golladay | A41F 9/00 | 2/302 |
| 1,792,128 | A * | 2/1931 | Stevenson | A41F 5/00 | 24/371 |
| 1,909,085 | A * | 5/1933 | Baer | A41F 5/00 | 2/324 |
| 2,128,583 | A * | 8/1938 | Goodrich | A41F 5/00 | 2/323 |
| 2,204,561 | A * | 6/1940 | Ashworth | A41F 5/00 | 24/351 |
| 3,452,401 | A * | 7/1969 | Trent | A41F 5/00 | 24/301 |
| 4,498,201 | A * | 2/1985 | Carter | A41F 9/00 | 2/220 |
| 4,941,213 | A * | 7/1990 | Grilliot | A41D 13/0005 | 2/232 |
| 4,947,489 | A * | 8/1990 | Greenwood | A41F 5/00 | 2/101 |
| 5,309,572 | A * | 5/1994 | Seamans | A41F 5/00 | 2/107 |
| 6,308,338 | B1 * | 10/2001 | Caldwell | A41D 1/062 | 2/312 |
| 8,813,266 | B1 * | 8/2014 | Green | A41D 1/062 | 2/229 |

* cited by examiner

BRACING STRUT FOR PREVENTING PANTS FROM SLIPPING DOWN

TECHNICAL FIELD

The present invention relates to a bracing strut for preventing pants from slipping down, wherein the pants are supported by a hip belt due to the bracing strut in such a manner that, after the hip belt is fastened on the wearer's body and then the pants are worn, both ends of the bracing strut are supported between the holder fastened to the waist band of the pants and the sockets provided at the hip belt, whereby the wearer can engage in daily activities freely, wearing a pair of formal pants for a dress suit, free from worries about the pants slipping down, free from pressure applied by a waist belt.

BACKGROUND ARTS

Wearing a waist belt has been a customary practice to hold the pants for a dress suit.

The waist belt, however, often caused a pressure to the wearer's abdomen, affecting the wearer's smooth breathing. In an attempt to resolve this problem, suspenders were used as an alternative.

DETAILED DESCRIPTION OF THE INVENTION

Technical Problem

When a pair of pants are worn with a waist belt, the waist belt is likely to pressure the wearer's abdomen, causing inconvenience in the wearer's respiration. The pressure applied to the abdomen could also affect the digestion of the food taken, causing inconvenience in the wearer's daily activities.

When suspenders are worn as an alternative, the straps hanging from the wearer's shoulders and fastened to the pants, the suspender straps hung over both sides of the dress shirt with a necktie worn thereto caused the wearer to appear somewhat childish and unbecoming as an adult. As well, the shoulder straps of the suspenders could slip from the wearer's shoulder, causing inconvenience in the wearer's daily activities.

Solution to the Problem

In the present invention, a new bracing strut for preventing pants from slipping down has been developed, whereby one can engage in daily activities freely, wearing the bracing struts of the present invention for the pants, without a waist belt or suspenders, free from inconvenient pressure applied to the wearer's abdomen, enabling the wearer to, maintain a tidy appearance wearing a pair of formal pants for a dress suit.

The object of the present invention is to provide a bracing strut for preventing pants from slipping down, whereby one can engage in daily activities freely, wearing the bracing struts in the present invention for the pants, without a waist belt or suspenders, free from pressure to wearer's abdomen, enabling the wearer to maintain tidy appearance.

Another object of the present invention is to provide a bracing strut for preventing pants from slipping down, wherein the upper support pole and the lower support pole of the bracing strut are coupled vertically through a connector, the lower end of the upper support pole being coupled with the connector from above and the upper end of the lower support pole coupled with the connector from below, with the upper end of the upper support pole being fastened to the holder (4) provided in the waist band (B) of the pants (P), the lower end of the lower support pole being fastened to the socket (5) provided at the hip belt (G) worn on the body of the wearer.

Still another object of the present invention is to provide a bracing strut for preventing pants from slipping down, wherein a hip belt (G) is worn, over which the pants are worn without a waist belt, with a pair of bracing struts supporting the pants between the holders provided on the left and right of the front side of the waist band of the pants and the sockets provided on the left and right of the front side of the hip belt, thereby preventing the pants from slipping down when a pair of formal pants are worn.

In the present invention, in order for a pair of pants to be worn comfortably and stably, a holder is provided on the left and right of the interior front side of the waist band of the pants; a buckle with a socket is provided on the left and right of the front side of the hip belt worn on the body of the wearer. After the hip belt is worn on the wearer's body and then the pants are worn, both ends of each bracing strut are supported on the left and right between the holders provided on the interior front side of the waist band of the pants and the sockets provided in the hip belt, thereby supporting the pants stably with the hip belt via the bracing strut.

Embedded in the tubular upper support pole of the bracing strut is an elastically sliding, spring-supported slider connected with a support rod; the upper open end of the upper support pole is screw-shut by a screw-driven lid; a spring-supported screw is installed at the lower end of the upper support pole; and a head bolt to be screw-coupled with a screw hole of the holder is provided at the upper end of the slider protruding from the upper support pole.

In the tubular lower support pole of the bracing strut is a slider connected with a support rod elastically sliding with a spring. The lower end opening of the lower support pole has an internal threaded portion for fixing with a screw. The lower end of the lower support pole has an internal threaded portion for fixing with a spring-sustaining screw. The lower end of the support rod protruding from the lower open end of the lower support pole is provided with a support ball to be supported by a socket.

The upper support pole and the lower support pole are each screw-coupled vertically with each respective coupling hole provided in the connector.

Attached to the interior front side of the waist band of the pants is a pair of fastening plates each provided with a holder having an internal threaded hole, into which the head bolt of the upper support pole of the bracing strut is screw-fixed. The buckle, which is fastened to the hip belt worn on the body of the wearer is provided with a socket having a ball seat for supporting the support ball provided at the lower end of the support rod of the lower support pole of the bracing strut.

When the total length of the bracing strut needs to be extended according to the stature of the wearing person, a tubular auxiliary connector of a certain desired length is provided, whereby the length of the bracing strut can be extended by screw-coupling the upper support pole and the lower support pole with each respective coupling member provided at both ends of the auxiliary connector.

According to the present invention, a hip belt is worn inclined from the waist toward the lower abdomen of the shirt-wearing person's body. Then a pair of pants are worn over the hip belt. Then the upper end of the bracing strut is fastened to the holders provided on the left and right of the interior front side of the waist band of the pants, and then the lower end of the bracing strut is fastened with and supported by the sockets provided on the left and right of the front side of the hip belt. By doing so, the bracing struts supporting between the waist band and the hip belt prevent the pants from slipping down.

As a ball seat is provided on the buckle, it is movable to the left or the right of the hip belt by moving the buckle along the hip belt. Accordingly, the positions of the buckles may be adjusted with respect to the positions of the holders appropriately, in a vertical straight line or in an inclined line by keeping the distance between the buckles longer than that between the holders.

When the holders and the buckles are positioned in a straight vertical line, the bracing struts supported between the holders and the buckles are in a parallel position; when the distance between the buckles is longer that that between the holders, the bracing struts are supported in somewhat an inclined, echelon form.

A pair of pants are worn over the hip belt that has been worn; the head bolt provided at the upper support pole of the bracing strut is screw-coupled with each of the holders fastened on the interior front side of the waist band of the pants; the support ball provided at the lower support pole of the bracing strut is supported by the ball seat of each of the sockets provided on the buckle attached to the hip belt; then the front portion of the pants are buttoned up or zipper-closed, so that the wearer's abdomen is shielded, being ready as a pair of formal pants suited for a dress suit.

Although the pants are free from a waist belt binding the wearer's waist, the hip belt is worn safely on the body of the wearing person toward the lower abdomen. Though unseen from the external view, the pants are supported internally by the bracing struts between the sockets of the hip belt and the holders of the waist band of the pants, thereby supporting and preventing the pants from slipping down.

When the wearer is engaged in physical activities, such as bending the back forward or backward, the ample measurement of the pants that is made possible by the present invention does not pressure the abdomen, presenting no difficulty in breathing.

Furthermore, without the straps of the conventional suspenders hanging from the shoulders, tidy appearance in a dress suit is made possible.

In taking off the pants, the balls of the bracing struts are separated from the sockets of the hip belt, causing no inconvenience in taking off the pants; then the head bolts of the bracing struts are separated from the holders in order to remove the bracing struts from the pants to store or launder the pants.

When the total length of the bracing strut needs to be extended according to the stature of the wearing person, an auxiliary tubular connector of a certain desired length is provided, whereby the length of the bracing strut can be extended by screw-coupling the upper support pole and the lower support pole with each respective coupling member provided in both end portions of the auxiliary connector, adding to the usefulness of the bracing struts.

Furthermore, the bracing struts may be disassembled component by component, making it easy to handle and manage the bracing struts before and after use, enabling every user to use the bracing struts conveniently.

Effect of the Invention

According to the present invention, a bracing strut for preventing pants from slipping down is provided, wherein the holders are provided on the left and right of the front side of the waist band of the pants, and the sockets formed on the buckles are provided, fastened on the left and right of the front side of the hip belt worn on the wearer's body. The wearer first wears the hip belt on his or her body; then the pants are worn; then both ends of the bracing struts are supported between the holders fastened on the interior front side of the waist band of the pants and the sockets attached on the hip belt, whereby the pants are supported to the hip belt by the bracing struts. Therefore, one can wear a pair of pants for a dress suit conveniently without a waist belt.

Furthermore, without a waist belt, the wearer is free from pressure on his abdomen. The wearing person can wear a dress suit in tidy appearance and can engage in daily activities freely. Thus, the bracing strut of the present invention offers an effect of using the present invention more conveniently than using the conventional waist belt or suspenders

A PREFERRED EMBODIMENT OF THE INVENTION

Figure 1:
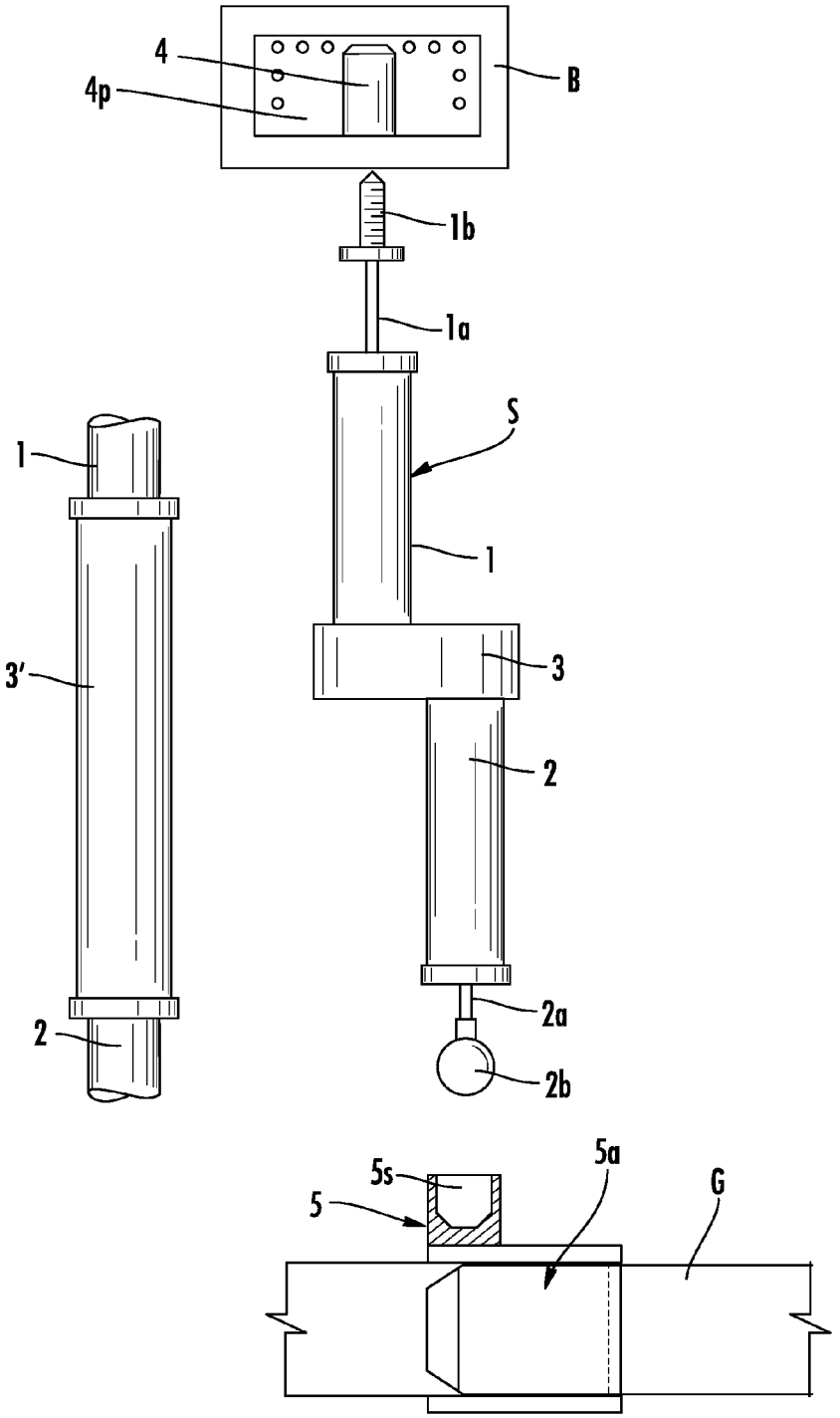
FIG. 1 is an illustrative view of the bracing strut in the present invention.

The present invention relates to a bracing strut for preventing pants from slipping down. Holders (4) are provided on the left, and right of the interior front side of the waist band (B) of the pants (P) sockets (5) formed on the buckle (5*a*) are provided on the left and right of the front side of the hip belt (G) worn on the body of the wearing person; the hip belt (G) is worn on the wearer's body, and then a pair of pants are worn; then both ends of each of the bracing struts (S) are supported between each of the holders (4) fastened to the interior front side of the waist band (B) of the pants (P) and the sockets (5) provided on the hip belt (G), so that the pants are supported to the hip belt by the bracing struts.

According to the present invention, in wearing a pair of pants, one need not wear a waist belt, freeing the wearer's abdomen from pressure. By not using suspenders, the straps do not hang over the wearer's shoulders, enabling one to engage in daily activities freely, wearing the pants comfortably in a dress suit.

The present invention relates to a bracing strut for preventing pants from slipping down, characterized with a composition comprising: a pair of holders (4) provided on the left and right of the interior front side of the waist band (B) of the pants (P); a pair of sockets (5) formed on the buckle (5*a*) provided on the left and right of the front side of the hip belt (G) worn on the body of the wearer; and a hip belt (G) worn on the wearer's body. In using the bracing struts (S), a pair of pants are worn first; then both ends of each of the bracing struts (S) are coupled and supported between each of the holders (4) fastened to the interior front side of the waist band (B) of the pants (P) and the sockets (5) provided on the hip belt (G), so that the pants are supported to the hip belt by the bracing struts.

The bracing struts (S) for preventing the pants from slipping down has a characteristic composition in that the bracing strut (S) consists of an upper support pole (1) provided with a head bolt (1*h*) for coupling and holding the holder (4) fastened to the interior front side of the waist band (B) of the pants and the lower support pole (2) provided with a support ball (2*b*) supported by the socket (5) formed on the buckle (5*a*) on the hip belt (G), wherein the upper support pole (1) and the lower support pole (2) of the bracing strut (S) are coupled vertically downwards (from above) and upwards (from below), respectively, with the coupling holes (3*a*, 3*b*) provided in the connector (3).

An Embodiment of the Invention

The present invention is explained in detail through an embodiment by the drawings attached as follows.

As shown in FIG. 1, the bracing strut (S) for preventing pants from slipping down consists of an upper support pole (1) and a lower support pole (2) vertically coupled via a connector (3), and a head bolt (1*h*) formed at the upper end of the support rod (1*a*) provided for the upper support pole (1) is screw-fastened to a holder (4) attached via a fastening plate (4*p*) to the interior front side of the waist band (B) of the pants (P); a support ball (2*b*) formed at the lower end of the support rod (2*a*) provided for the lower support pole (2) is supported by a ball seat (5*s*) of the socket (5) formed on the buckle (5*a*) mounted on the hip belt (G) worn on the body of the wearer, thereby making it possible for the bracing strut (S) to support the pants (P) safely and stably to the hip belt (G) without a waist belt.

Figure 2:
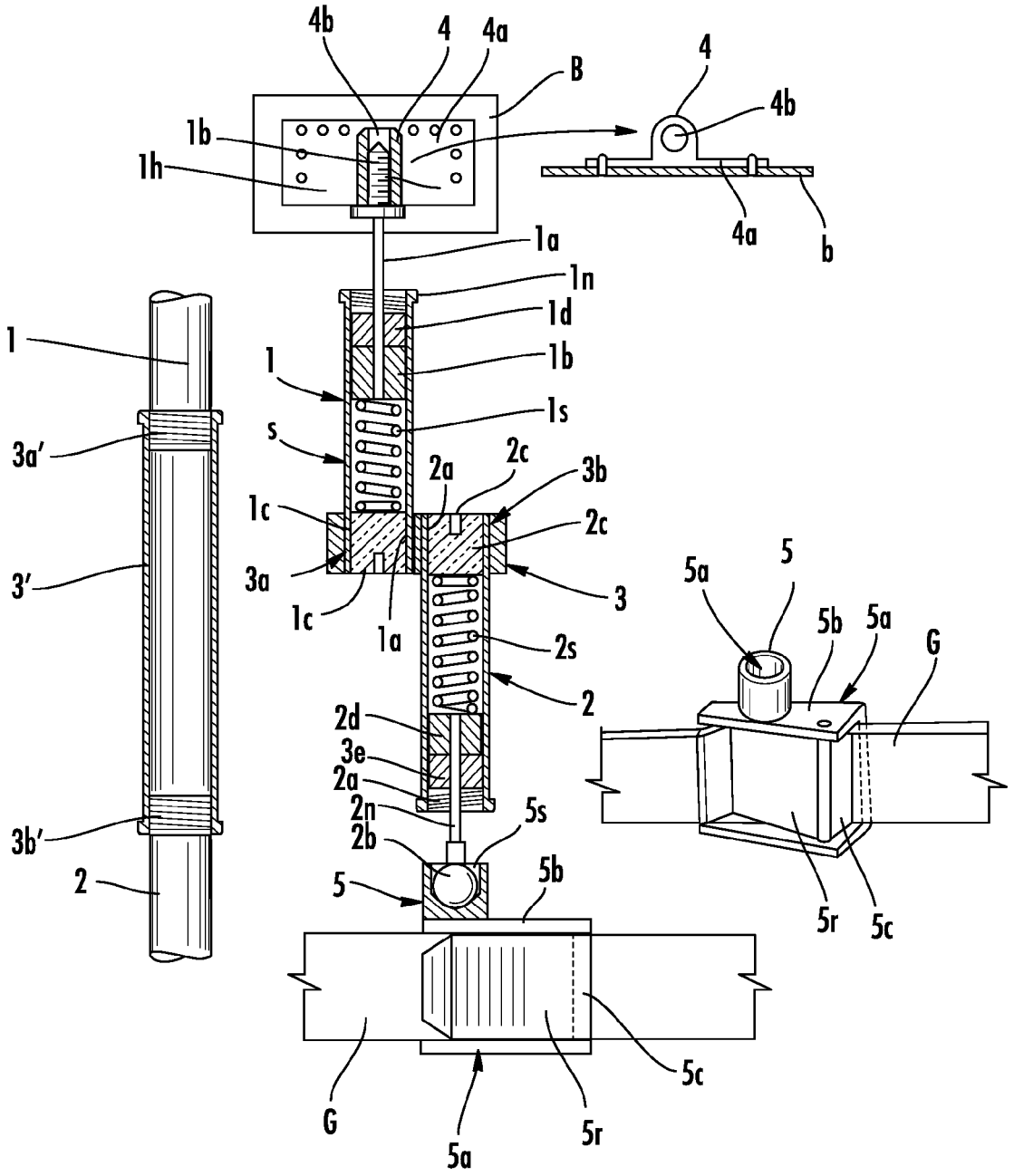
FIG. 2 shows sectional views of the specific composition of the bracing strut of the present invention.

As shown in FIG. 2, the lower end of the tubular upper support pole (1) of the bracing strut (S) has an internal threaded portion (1*u*) into which a spring-sustaining screw (1*t*) is screw-fastened; a slider (1*b*) connected with a support rod (1*a*) is provided in the upper support pole (1) with a spring (1*s*) to be supported by a spring-sustaining screw (1*t*); a screw (1*d*) is screw-fixed at an internal threaded open portion (1*n*) such that the support rod (1*a*) may protrude outside the upper support pole (1); and a head bolt (1*h*) with a flange (1*f*) is formed at the upper end of the support rod (1*a*).

The tubular lower support pole (2) of the bracing strut (S) has an internal threaded portion (2*u*) into which a spring-sustaining screw (2*t*) is screw-fastened; a slider (2*d*) connected with a support rod (2*a*) is provided in the lower support pole (2) with a spring (2*s*) to be supported by a spring-sustaining screw (2*t*); a screw (2*c*) is screw-fixed at an internal threaded open portion (2*n*) such that the support rod (2*a*) may extrude outside the lower support pole (2); and a support ball (2*b*) is formed at the lower end portion of the support rod (2*a*).

The screw portion (1*c*) of the upper pole (1) is vertically screw-coupled from above into either (3*a*) of the internal threaded coupling holes (3*a*, 3*b*) provided in the connector (3); and the screw portion (2*c*) of the lower support pole (2) is vertically screw-coupled from below into the remaining internal threaded coupling hole (3*b*) provided in the connector (3), thereby composing the entire structure of the bracing strut (S).

The holder (4) with which the upper support pole (1) of the bracing strut (S) is coupled is provided with an internal threaded hole (4*h*) into which the head bolt (1*h*) of the upper support pole (1) is screw-fastened; and the holder (4) is fastened to a predetermined place on the interior front side of the waist, band (B) of a pair of pants via a fastening plate (4*p*).

The socket (5) with which the lower support pole (2) of the bracing strut (S) is to be coupled is provided with a ball seat (5*s*) supporting the support ball (2*b*) of the lower support pole (2); the socket (5) is provided on the side plate (5*b*) of the buckle (5*a*) fastened via a lever (5*r*) and a clamp (5*c*) of the buckle (5*a*) in a predetermined position of the hip belt (G) worn on the wearer's body separate from the pants.

Moreover, for use when the total length of the bracing strut (S) needs to be extended according to the stature of the wearing person, internal threaded coupling members (3*a*') (3*b*') of a certain desired length are provided at both end portions of an auxiliary tubular connector (3'), whereby the length of the bracing strut (S) can be extended by screw-coupling the screw member (1*c*) of the upper support pole (1) and the screw member (2*c*) of the lower support pole (2) with each coupling member (3*a*', 3*b*') of the auxiliary connector (3').

Figure 3:
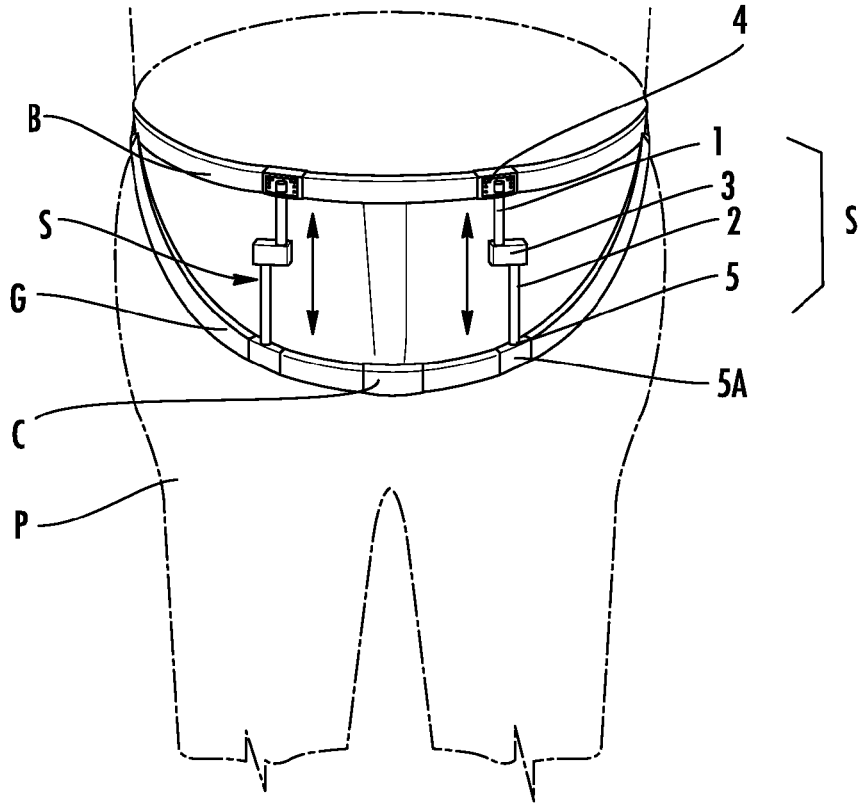
FIG. 3 is an illustrative front view of the bracing struts worn on the wearer's body.
Figure 4:
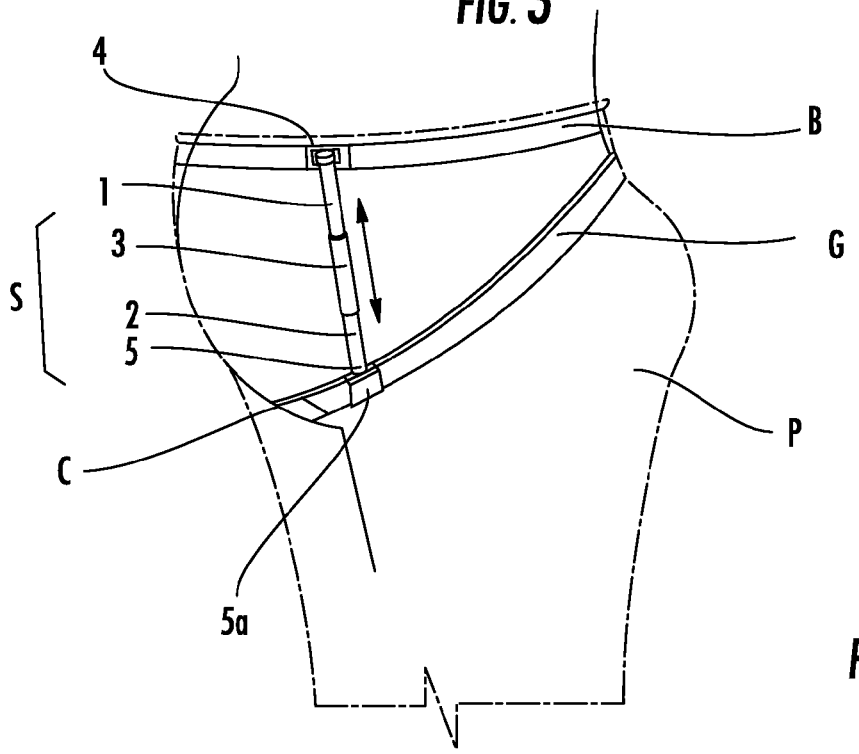
FIG. 4 is an illustrative side view of the bracing struts worn on the wearer's body.

As shown in FIG. 3 and FIG. 4, the bracing strut of the present invention with a composition as explained above is provided with a pair of holders (4) attached to the interior front side of the waist band (B) of the pants (P) on its left and right of the front side at a certain interval in such a way that the internal threaded hole 4*h*) of the holder (4) may face downwards, the holders (4) being attached to the interior front side of the waist band (B) by sewing, riveting or other suitable means. The holders (4) are always attached to the waist band (B) of the pants (P) beforehand.

Also, a pair of sockets (5) are firmly fixed to the hip belt (G) on its left and right of the front side at an interval corresponding with that of the holders (4) in such a way that each socket (5) with a buckle (5*a*) may face upwards, the fixing of the socket with the buckle being made firmly via a clamp (5*c*) and a lever (5*r*). The positions of the buckles (5*a*) attached to the hip belt (G) are movable for adjustment along the hip belt (G) leftwards or rightwards via the lever (5*r*) and the clamp (5*c*) on the left and right. Separation of the buckles is possible, but this is unnecessary under normal circumstances.

After wearing a shirt, as shown in FIG. 3 and FIG. 4, a hip belt (G) is worn, in the first place, safely inclined from the waist towards the lower abdomen using an ordinary buckle (C). As the hip belt (G) is worn hung on the hip, the hip belt (G) is attached to the wearer's body in a manner unlikely to slip down while walking or engaged in daily activities.

The hip belt (G) is designed to support the pants; it is not intended to bind the waist of the pants; it is separated from the waist band (B). The sockets (5) are fixed to the hip belt (G) via the buckles (5*a*) on the left and right of the front side of the hip belt (G).

After the hip belt (G) is worn, the pants (P) are worn over the hip belt (G). The pants (P) are made with ample measurement, and without a waist belt, the pants are worn comfortably. After wearing the pants, the front of the abdomen is shielded.

In the first place, the pants are worn, then the head bolt (1*h*) provided for the upper pole (1) of the bracing strut (S) is screwed into the internal threaded hole (4*h*) of the holder (4) attached on the left and right of the front side of the waist band (B) of the pants (P) until the flange (1*f*) contacts the holder (4), thereby fastening a pair of the bracing struts (S) to the holders (4) one by one; then the support ball (2*b*) provided for the lower support pole (2) of the bracing strut (S) is inserted into the ball seat (5*s*) of the socket (5) arranged on the left and right of the front side of the hip belt (G).

When both ends of the bracing struts (S) are coupled with the holders (4) arranged on the pants (P) and with the sockets (5) arranged on the hip belt (G), the waist band (B) of the pants (P) is supported to the hip belt (G) via the bracing struts (S), whereby the pants are prevented from slipping down, without a waist belt being used. Needless to say, the abdomen is shielded.

As the total length of the bracing strut (S) is predetermined in order to match the distance between the waist band (B) of the pants (P) and the hip belt (G), the pants are placed in an appropriate position. Therefore, when the bracing struts (S) are coupled between the pants and the hip belt, the front portion of the pants is closed with buttons or a zipper.

Without a waist belt worn, the wearer of the pants feels free and comfortable around his or her waist. Moreover, as the hip belt (G) is safely worn toward the lower abdomen. The bracing struts (S), hidden from the external view, support the pants between the sockets (5) on the hip belt (G) and the holders (4) on the pants (P), preventing the pants from slipping down.

With ample measurement applied to the pants, the wearer does not feel pressure on his or her abdomen even in such activities as bending or stretching the waist. Free from pressure applied from the hip belt or from the waist belt to the abdomen, the wearer of the pants has no difficulty in breathing.

The wearer's body movement could bring about variations in the distance and the position of the holders (4) of the pants (P) and the sockets (5) of the hip belt (G). In other words, if the distance gets longer between the holders (4) of the pants (P) and the sockets (5) of the hip belt (G), the elastic force of the somewhat compressed springs (1*s*, 2*s*) extends the support rod (1*a*) of the upper support pole (1) and the support rod (2*a*) of the lower support pole (2) to respond to the extension of the distance, the support strength of the bracing struts (S) being unimpaired.

As well, if the distance gets shorter between the holders (4) of the pants (P) and the sockets (5) of the hip belt (G), the compressing action initiated by the holders (4) and the sockets (5) leads the support rod (1*a*) of the upper support pole (1) and the support rod (2*a*) of the lower support pole (2) to compress the springs (1*s*, 2*s*), shrinking the length of the bracing strut (S), responding to the shortening of the distance, the support strength of the bracing struts (S) being unimpaired.

If the positions of the holders (4) of the pants (P) change to the left or to the right against the sockets (5) of the hip belt (G), the bracing struts (S) respond to such positional and distance changes of the holders (4) and the sockets (5) by the aforesaid extending or shrinking actions, maintaining its supporting role, wherein the support ball (2*b*) freely rotating in the ball seat (5*s*) of the socket (5) at appropriate angles, the bracing struts (S) performing its supporting action unimpaired.

Therefore, when a pair of pants are worn without a waist belt, the wearer can engage in daily activities freely free from worries about the pants slipping down.

Moreover, without the conventional straps of the suspenders hanging from the shoulders, one can realize the desired tidy appearance in a dress suit.

When taking off the pants, the wearer removes the support balls (2*b*) provided for the lower support poles (2) of the bracing struts (S) from the ball seats (5*s*) of the sockets (5) on the hip belt (G).

As well, the bracing struts (S) can be removed from the pants (P) by separating by unscrewing the head bolt (1*h*) of the upper support pole (1) from the holders (4) of the pants (P), for storage or laundry that is needed.

Moreover, the total length of the bracing strut (S) can be extended according to the stature of the wearing person, by longitudinally screw-coupling the screw portion (1*c*) of the upper support pole (1) and the screw portion (2*c*) of the lower support pole (2) with each respective coupling member (3*a*', 3*b*') of the auxiliary connector (3'), thus enabling the bracing strut (5) to be extended to meet the variable situation conveniently.

A preferred embodiment of the present invention is explained as above. However, one skilled in the art may be able to put into practice variously from the claims of the present invention without deviating from the idea and domain of the present invention. Therefore, it is obvious that such alterations and variations must belong to the scope of the protective rights of the present invention.

What is claimed is:

1. A bracing strut (S) for preventing a pair of pants (P) from slipping down comprising:

a pair of holders (4) reversibly fastened to a left and a right of an interior of a front side of a waist band (B) of the pair of pants (P); and a pair of sockets (5) formed on a buckle (5*a*) provided on a left and a right of a front side of a hip belt (G) worn on the body of the wearer;

characterized in that after the hip belt (G) is worn on the body of the wearer, the pair of pants (P) are worn, both ends of the bracing strut (S) are coupled between each respective holder (4) provided on the interior front side of the waist band (B) of the pants (P) and each holder (4) having a corresponding lower support pole (2), each lower support pole (2) further defining a support ball (2*b*) each support ball (2*b*) designed for operatively engaging with each respective socket (5) formed on the buckle (5*a*) provided on the hip belt (G), thereby enabling the pair of pants (P) to be supported to the hip belt (G) by the bracing struts (S).

2. The bracing strut (S) for preventing the pair of pants (P) from slipping down as claimed in claim 1, wherein the bracing strut (S) consists of an upper support pole (1) provided with a head bolt (1*h*) to be coupled with and held to the holder (4) provided on the interior front side of the waist band (B) of the pants (P) and the lower support pole (2) provided with the support ball (2*b*) supported by the socket (5) formed on the buckle (5*a*) attached to the hip belt (G) worn on the body of the wearer, and wherein the upper support pole (1) and the lower support pole (2) of the bracing strut (S) are coupled vertically through a connector (3) from above and from below, respectively, with one of a plurality of coupling holes (3*a*, 3*b*) provided in the connector (3).

3. An apparatus for preventing pants from slipping down comprising:

a first holder and a second holder fastened a space distance apart to an interior side of a waistband of a pair of pants;

a hip belt adapted to be worn on a body and having at least one buckle, the at least one buckle having attached thereto a socket;

a bracing strut designed for reversibly attaching a first terminus of the bracing strut to one of the first holder or the second holder, the bracing strut further defining a second terminus defining a ball, the ball operatively engaging the socket in a reversible connection;

wherein when the bracing strut is connected to one of the first holder or the second holder, and further connected to the socket of a hip belt, the pair of pants is supported on the wearer's body.

4. The apparatus according to claim 3 wherein the hip belt defines a first buckle and a second buckle, the first buckle and the second buckle being spaced apart and each buckle further defining a corresponding socket.

5. The apparatus according to claim 4 wherein the socket defined by the first buckle and the socket defined by the second buckle are each designed for engaging a corresponding ball carried by the bracing strut.

6. The apparatus according to claim 5 wherein the first terminus of the bracing strut is carried by a cylindrical rod, an interior of the cylindrical rod defining a compression spring, the spring allowing axial movement between the bracing strut and the corresponding holder.

7. The apparatus according to claim 6 wherein the second terminus of the bracing strut is carried by a cylindrical rod, an interior of the cylindrical rod defining a compressive spring, the spring allowing axial movement between the bracing strut and the hip belt when the ball is attached to a corresponding socket of a hip belt.

* * * * *